US011490671B2

(12) United States Patent
Chen

(10) Patent No.: US 11,490,671 B2
(45) Date of Patent: Nov. 8, 2022

(54) COMBUSTION-RESISTANT ARTIFICIAL TREE

(71) Applicant: Willis Electric Co., Ltd., Taipei (TW)

(72) Inventor: Johnny Chen, Taipei (TW)

(73) Assignee: Willis Electric Co. Ltd., Taipei (TW)

( * ) Notice: Subject to any disclaimer, the term of this patent is extended or adjusted under 35 U.S.C. 154(b) by 85 days.

(21) Appl. No.: 16/519,933

(22) Filed: Jul. 23, 2019

(65) Prior Publication Data

US 2020/0345092 A1 Nov. 5, 2020

Related U.S. Application Data

(63) Continuation of application No. 15/349,457, filed on Nov. 11, 2016, now Pat. No. 10,357,071.

(60) Provisional application No. 62/256,805, filed on Nov. 18, 2015.

(51) Int. Cl.

| | |
|---|---|
| ***A41G 1/00*** | (2006.01) |
| ***A47G 33/06*** | (2006.01) |
| *A47G 33/04* | (2006.01) |

(52) U.S. Cl.

CPC ..... *A41G 1/007* (2013.01); *A47G 33/06* (2013.01); *A47G 33/04* (2013.01)

(58) Field of Classification Search

CPC ..... A41G 1/007; A47G 33/06

See application file for complete search history.

(56) References Cited

U.S. PATENT DOCUMENTS

| | | | | |
|---|---|---|---|---|
| 860,406 | A | 7/1907 | McGahan | |
| 1,694,974 | A | 12/1928 | Glover | |
| 3,118,617 | A | 1/1964 | Hellrich | |
| 3,513,063 | A | 5/1970 | Sloane | |
| 3,594,260 | A | 7/1971 | Dieffenbach | |
| 3,819,457 | A | 6/1974 | Mottel | |
| 3,834,976 | A | 9/1974 | Mottel | |
| 3,931,386 | A * | 1/1976 | Kimura | C08G 8/04 264/236 |

(Continued)

FOREIGN PATENT DOCUMENTS

JP 2012017533 A * 1/2012

OTHER PUBLICATIONS

Blumendraht Floral Wire Factory, "Floral Stem Wire, 16-32 gauge, 20-60cm", 2011, p. 1-2; Accessed at https://web.archive.org/web/20130310144507/https://www.floralwire.net/floral-wire/painted-floral-stem-wire.html.*

(Continued)

*Primary Examiner* — Mark Ruthkosky
*Assistant Examiner* — Julia L Rummel
(74) *Attorney, Agent, or Firm* — Christensen, Fonder, Dardi & Herbert PLLC

(57) ABSTRACT

A combustion-resistant branch assembly for an artificial tree, the branch assembly including a first branch portion including a first rod having a main portion intermediate a first end portion and a second end portion; a first group of sub-branches attached to the first branch portion, each sub-branch of the first group of sub-branches including a member having a first end portion; and a first winding, including a combustion-resistant strand, wrapped about the first end portion of the first rod of the first branch portion and the first end portion of each sub-branch of the first group of sub-branches, thereby attaching the first group of sub-branches to the first branch portion.

6 Claims, 11 Drawing Sheets

(56) References Cited

U.S. PATENT DOCUMENTS

| | | | | |
|---|---|---|---|---|
| 4,109,345 | A | 8/1978 | Sargent et al. | |
| 4,273,814 | A | 6/1981 | Koehler | |
| 4,305,980 | A | 12/1981 | Spiegel et al. | |
| 4,343,842 | A | 8/1982 | Chase | |
| 4,590,105 | A | 5/1986 | Shaffer | |
| 4,774,113 | A * | 9/1988 | Shaffer | A47G 33/06 156/61 |
| 5,780,152 | A * | 7/1998 | Ichiryu | D02G 3/443 428/357 |
| 6,056,427 | A | 5/2000 | Kao | |
| 6,093,459 | A * | 7/2000 | Puleo, Jr. | A41G 1/00 428/19 |
| 6,117,503 | A | 9/2000 | Lee et al. | |
| 6,276,120 | B1 | 8/2001 | Adriaesen | |
| 6,861,108 | B1 | 3/2005 | Shaffer | |
| 7,055,981 | B2 | 6/2006 | Yao | |
| 8,454,186 | B2 | 6/2013 | Chen | |
| 8,454,187 | B2 | 6/2013 | Chen | |
| 8,569,960 | B2 | 10/2013 | Chen | |
| 8,936,379 | B1 | 1/2015 | Chen | |
| 8,974,072 | B2 | 3/2015 | Chen | |
| 9,044,056 | B2 | 6/2015 | Chen | |
| 9,140,438 | B2 | 9/2015 | Chen | |
| 9,157,587 | B2 | 10/2015 | Chen | |
| 9,157,588 | B2 | 10/2015 | Chen | |
| 9,179,793 | B2 | 11/2015 | Chen | |
| 9,222,656 | B2 | 12/2015 | Chen | |
| 9,243,788 | B2 | 1/2016 | Chen | |
| 9,439,528 | B2 | 9/2016 | Chen | |
| 9,441,800 | B1 | 9/2016 | Chen | |
| 9,441,823 | B1 | 9/2016 | Chen | |
| 9,484,687 | B1 | 11/2016 | Chen | |
| 9,526,286 | B2 | 12/2016 | Chen | |
| 2004/0080281 | A1 | 4/2004 | Pan | |
| 2007/0091606 | A1 | 4/2007 | Reed | |
| 2013/0308301 | A1 | 11/2013 | Chen | |

OTHER PUBLICATIONS

Greenden, "Galvanized Wire", 2009, p. 1-2; Accessed at https://web.archive.org/web/20100416012835/https://www.floralwire.org/floral-wire/galvanized-wire.html.*

English language translation of JP2012-01733A, generated with Espacenet website (https://www.epo.org/searching-for-patents/technical/espacenet.html).*

Pyromation, "Wire: Standard Wire Gauge Conversions", 2001, p. 1; Accessed at https://web.archive.org/web/20030310131224/https://www.pyromation.com/Catalog/w03.pdf.*

Lights and Decor, "How to Hang Outdoor Globe String Lights," 2014, p. 1-4; accessed at http://web.archive.org/web/20140724050811/http://www.lightsforalloccassions.com/p-4854-how-to-hang-outdoor-globe-string-lights.aspx.

Engineering Toolbox, "Metals-Melting Temperatures," 2012, p. 1-2; accessed at http://web.archive.org/web/20120104182824/http://www.engineeringtoolbox.com:80/melting-temperature-metals-d_860.html.

* cited by examiner

COMBUSTION-RESISTANT ARTIFICIAL TREE

CROSS-REFERENCE TO RELATED APPLICATIONS

The present application is a continuation of U.S. patent application Ser. No. 15/349,457, filed Nov. 11, 2016, which claims the benefit of U.S. Provisional Patent Application No. 62/256,805, filed Nov. 18, 2015, which is hereby incorporated by reference herein in its entirety.

FIELD OF THE DISCLOSURE

The present disclosure relates to artificial trees. More specifically, the present disclosure relates to a combustion-resistant branch assembly including a branch portion and a plurality of connected sub-branches.

BACKGROUND OF THE DISCLOSURE

For the sake of convenience and safety, consumers often substitute artificial trees, constructed of metal and plastic, for natural trees when decorating homes, offices, and other spaces, especially during the holidays. Such artificial trees generally include multiple tree sections joined at the trunk and held erect by a floor-based tree stand. Traditionally, consumers wrap strings of lights about the artificial tree, or lights are included as a part of a tree to enhance the decorative quality of the tree display.

Where fire safety is concerned, modern artificial trees present a relatively safe alternative to natural trees that can get dried out and pose a serious fire threat. However, even modern artificial trees made of metal and plastics still pose a fire threat. For example, even when flame retardant materials are used, when temperatures rise sufficiently, artificial tree branches may still ignite. After ignition, the high concentration of plastics in the tree provide an abundant fuel source, potentially resulting in a rapid increase in temperature and subsequent ignition of the entire tree, often from bottom branches to top branches.

SUMMARY OF THE DISCLOSURE

Aspects of the disclosure are directed to an artificial tree including a trunk portion and a plurality of branch assemblies coupled to the trunk portion. The plurality of branch assemblies may include a plurality of attached sub-branches for simulating the appearance of foliage in a real tree. In various embodiments, the branch assemblies include a rod, which in some embodiments may be metal, and the plurality of sub-branches are attached to the rod via a combustion-resistant winding. In one or more embodiments, the combustion-resistant winding includes a combustion-resistant wire, such as a metal thread, wrapped about the rod and an end portion of each of the plurality of sub-branches to attach the rod and the sub-branches together.

One or more embodiments of the disclosure provide an improved artificial tree with improved combustion resistance characteristics. For example, certain embodiments include a combustion-resistant winding that is at least partially composed of a metallic portion, such as steel, iron, or other combustion-resistant wire or thread that secures the sub-branches to the branch assembly. As such, one or more embodiments provide a more resilient connection between the sub-branches and the branch assemblies that can withstand relatively high temperatures, such as during a fire.

Various embodiments assist to maintain the sub-branches of an artificial tree in an advantageous spacing arrangement that decreases the risk of fire spread in the artificial tree. The spread out distribution of material in the artificial tree may limit the amount of material available to fuel a fire. For example, a conventional system 20 for manufacturing branches is depicted in FIG. 1. The system 20 includes a branch wrapping device 24 configured to receive a metal rod 28 and a plurality of sub-branches 32 and attach the two together. For example, as the metal rod 28 and sub-branches 32 are passed through the device 24, the device 24 intakes a polymer thread 36 and spins a length of the polymer thread 36 about the metal rod 28 and the sub-branches 32. The result is a branch having a winding or wrap of polymer thread 36 along a length of the metal rod 28 to hold the various sub-branches 32 to the metal rod 28.

Referring to FIGS. 2A-2D various stages of progression of a fire in a conventional artificial tree 40 are depicted. The artificial tree 40 includes a trunk portion 44 and a plurality of outwardly extending branches 48. The trunk portion 44 is mounted in a stand or base portion 56 for supporting the artificial tree 40 in a standing upright position. As described with reference to FIG. 1, each of the branches 48 include a metal rod 28 and a plurality of sub-branches 32 outwardly extending from the metal rod 28. Each of the sub-branches 32 include artificial foliage 52 for simulating the look and/or feel of a real tree. Each of the sub-branches 32 are attached to the metal rod 28 via a polymer thread winding 54, which is wrapped about the metal rod 28 and an end portion 55 of the various sub-branches 32 to attach the two together.

In FIG. 2B, a fire 60 is started in a branch 48 of the tree 40. Depicted in FIGS. 2B-2C, rather than self-extinguish which is a possibility for a single sub-branch 32 having flame-retardant material, as time passes, the fire 60 consumes or melts the polymer thread winding 54 along the branch 48, such that the various sub-branches 32 are freed from the metal rod 28, and begin to fall off the metal rod 28 and downward towards the base portion 56 of the tree 40. As a result, the artificial foliage 52, such as polymer needles, and other materials that may be present in the tree 40, such as decorations or the like, begin to accumulate and form a pile 64 near the base of the tree, including at or near the base portion 56.

In the pile 64, the artificial foliage 52, sub-branches 32, decorations, and other materials in the tree 40 provide a larger and more concentrated fuel source for the fire 60. Further, while various materials in the tree 40, such as the artificial foliage 52, may be chemically treated to resist combustion, this resistance is limited, and at some point these materials will ignite provided enough heat. The result is a more serious fire 66 fueled by the pile 64 that may spread upward from the base portion 56 of the tree 40 or outwardly to other objects in the room or area in which the tree 40 is located.

Accordingly, one or more embodiments are directed to a combustion-resistant branch assembly for an artificial tree. The branch assembly may include a first branch portion including a first rod having a main portion intermediate a first end portion and a second end portion. The first branch portion may include a first group of attached sub-branches. In one or more embodiments each sub-branch includes a flexible member having a first end portion and a second end portion and a strip of artificial foliage attached along a portion of the flexible member. In various embodiments the strip of artificial foliage includes a plurality of polymer strands extended outwardly from the flexible member. In one or more embodiments the branch assembly includes a first winding wrapped latitudinally about the first branch portion and the first end portion of each sub-branch of the first group of sub-branches, thereby attaching the first group of sub-branches to the first branch portion. In various embodiments the first winding includes a combustion-resistant wire, strand or thread.

Another embodiment is also directed to a combustion-resistant branch assembly for an artificial tree. The branch assembly includes a first branch portion including a first rod having a main portion intermediate a first end portion and a second end portion; a first group of sub-branches attached to the first branch portion, each sub-branch of the first group of sub-branches including a member having a first end portion; and a first winding, including a combustion-resistant strand, wrapped about the first end portion of the first rod of the first branch portion and the first end portion of each sub-branch of the first group of sub-branches, thereby attaching the first group of sub-branches to the first branch portion.

Another embodiment is directed to a combustion-resistant artificial tree assembly comprising: a trunk portion; a first plurality of branch assemblies coupled to the trunk portion, each of the first plurality of branch assemblies including: a first branch portion including a first rod having a main portion intermediate a first end portion coupled to the trunk portion and a second end portion; a first group of sub-branches attached to the first branch portion, each sub-branch of the first group of sub-branches including a member having a first end portion; and a first winding, including a combustion-resistant strand, wrapped about the first end portion of the first rod of the first branch portion and the first end portion of each sub-branch of the first group of sub-branches, thereby attaching the first group of sub-branches to the first branch portion.

Other embodiments are directed to methods and processes of manufacturing a combustion-resistant branch assembly. One such embodiment includes: connecting a first end portion of a first group of sub-branches to a first branch portion, the first branch portion including a first rod having a main portion intermediate a first end portion and a second end portion, and each sub-branch of the first group of sub-branches including a flexible member having the first end portion and a second end portion and a strip of artificial foliage attached along a portion of the flexible member, the strip having a plurality of polymer strands extended outwardly from the flexible member; and winding a combustion-resistant strand latitudinally about the first branch portion and the connected first end portion of each sub-branch of the first group of sub-branches, thereby attaching the first group of sub-branches to the first branch portion. In an embodiment, the combustion-resistant strand is included in a combustion-resistant twine that further includes a polymer thread intertwined with the combustion-resistant wire.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
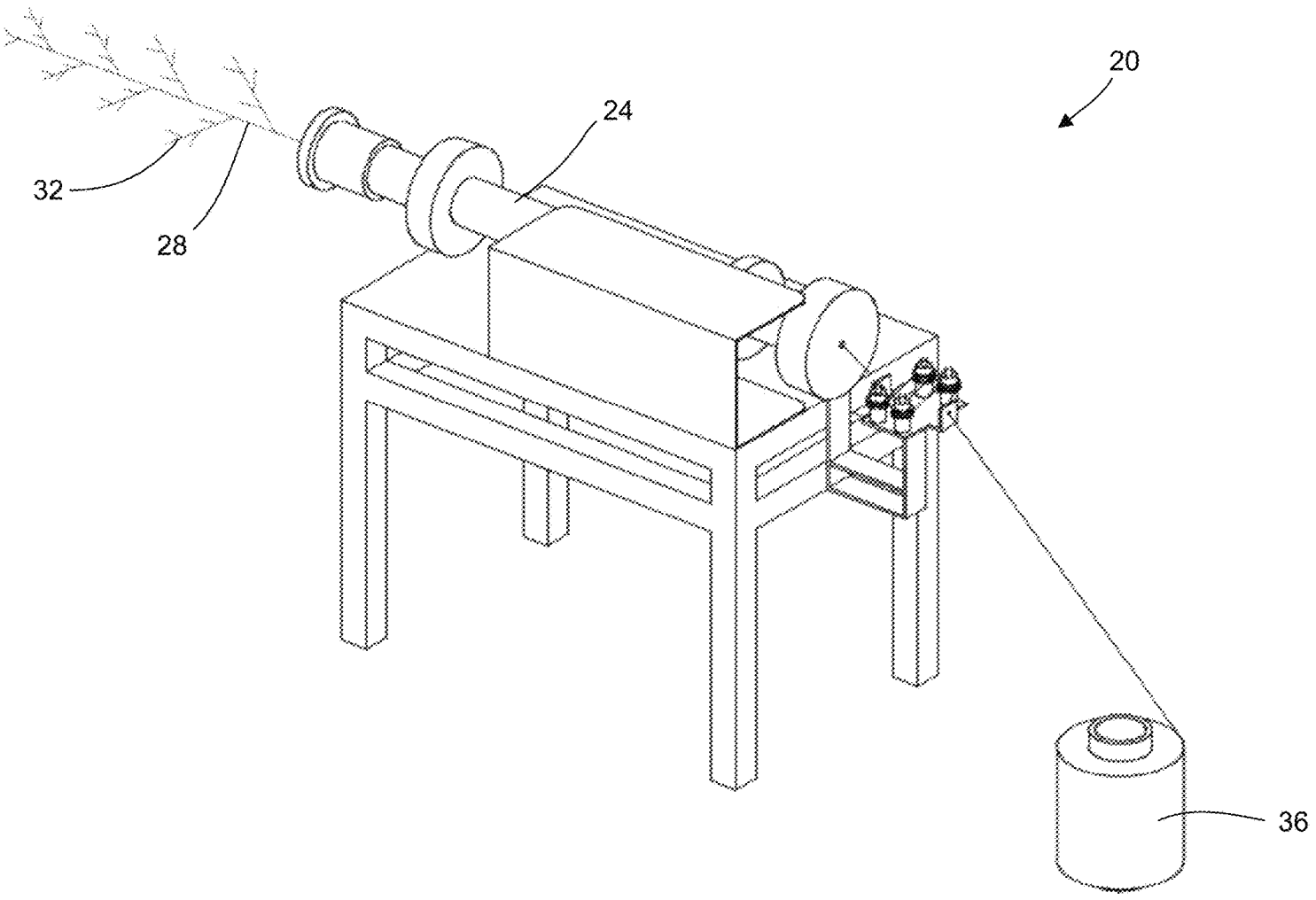
PRIOR ART FIG. 1
FIG. 1 depicts a conventional system for manufacturing a branch in an artificial tree.
Figure 2B:
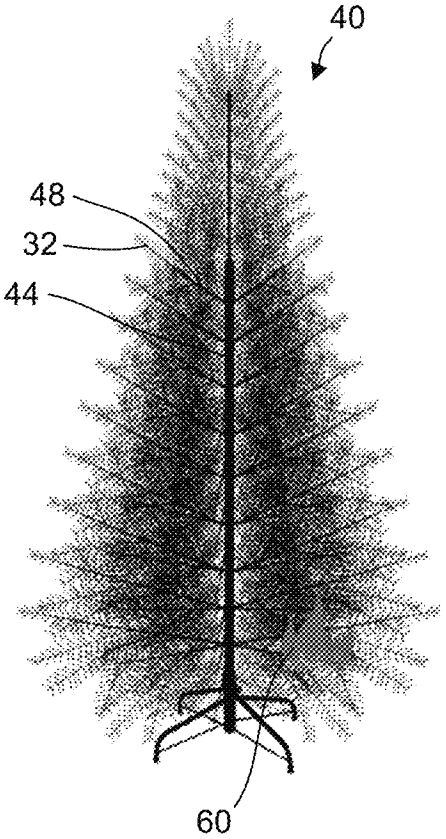
FIGS. 2B-2D depicts various stages of combustion of the conventional artificial tree of FIG. 2A.
Figure 2A:
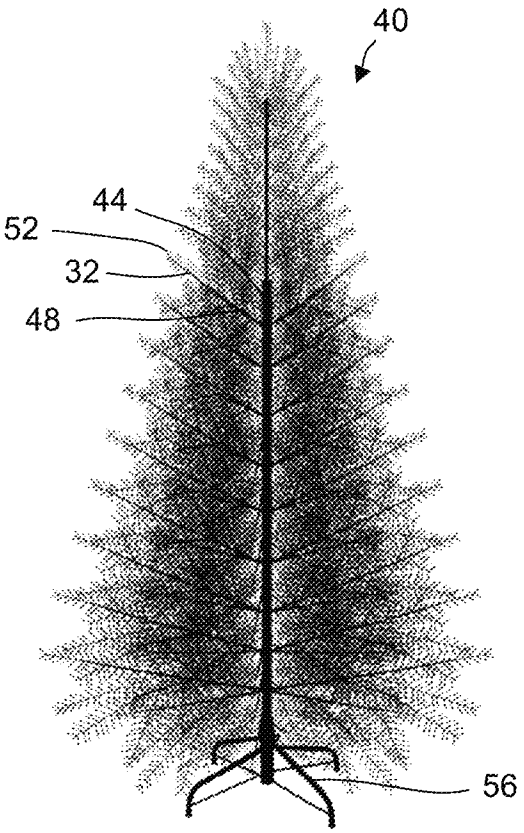
FIG. 2A depicts a conventional artificial tree.
Figure 2D:
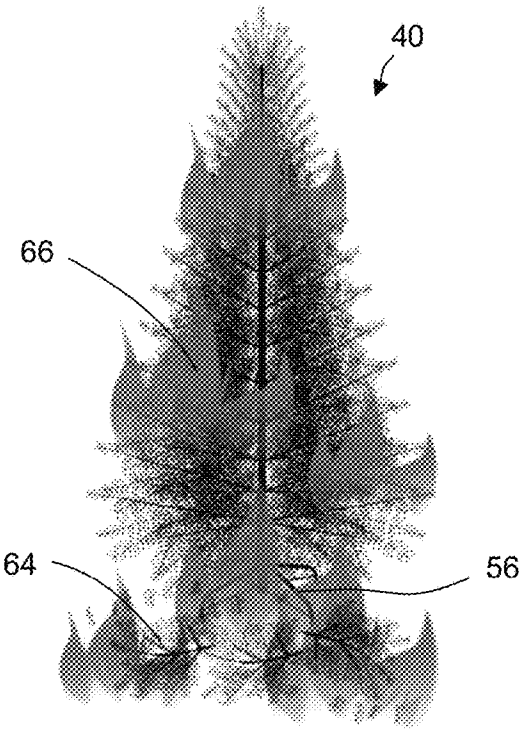
Figure 2C:
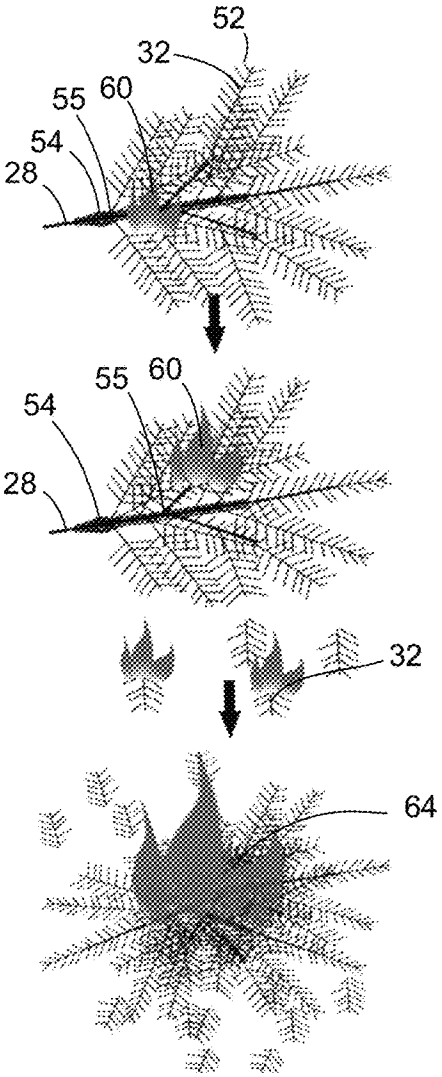

While the disclosed embodiments are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIGS. 3A-4B, a branch assembly 84 for an artificial tree is depicted, according to one or more embodiments of the disclosure. The branch assembly 84 may include a first branch portion 88 including a winding 92 attaching a group 96 of one or more sub-branches 98 attached to the first branch portion 88. In one or more embodiments, the branch assembly 84 additionally includes a second branch portion 104 attached to the first branch portion 88 via the winding 92. The second branch portion 104 may include a winding 108 disposed along a portion of the second branch portion 104, and a group 112 one or more sub-branches 98 attached via the winding 108.

In one or more embodiments, the first branch portion 88 includes a substantially rigid rod 116. The rod 116 is an elongated member including a main portion 120 intermediate a first end portion 124 for attaching to a trunk portion of an artificial tree, and a second end portion 128 for extending outwardly from the trunk portion. In certain embodiments, the second branch portion 104 includes a second rod 132. The second rod 132 is an elongated member including a main portion 136 intermediate a first end portion 140 for attaching to the first branch portion 88, and a second end portion 144 for extending outwardly from the first branch portion 88. The first and second rods 116, 132 may be composed of various rigid or semi-rigid materials, such as steel, iron, or other suitable materials, including plastic in some embodiments.

In an embodiment, each of rod 116 and rod 132 defines a generally circular cross section, such that rod 132 forms a generally cylindrical shape, though in other embodiments, rod 116 may comprise a square or rectangular, or other shape, viewed in cross section. In an embodiment, rod 116 defines a circular cross section, and rod 132 defines a rectangular cross section. In such an embodiment, rod 116 may have a larger diameter as compared to one or both of the lengths of the rectangular sides of rod 132 (viewed in cross section). Such an embodiment provides for a stiff, strong rod 116 not easily bent, while rod 132 may be more easily bent in the manufacturing process for attachment to rod 116, as depicted in FIG. 3B.

In an embodiment, a diameter of rod 116 may vary depending on its length, and therefore, depending on the desired length of branch assembly 84. Larger trees generally will require relatively longer branches, as compared to smaller trees, with respect to tree height and girth. In an embodiment, a diameter of rod 116 may be in the range of 0.1 cm to 1 cm, with 0.1 cm corresponding to a relatively short branch, and 1 cm diameter corresponding to a relatively long branch. In an embodiment, a diameter of rod 116 may be in the range of 0.3 to 0.6 cm. In one such embodiment, the diameter range of 0.3 cm to 0.6 cm will correspond to trees having heights ranging from 4 ft. to 12 ft. In an embodiment, a diameter of rod 116 may be in the range of 0.4 cm to 0.5 cm; in an embodiment, a diameter of rod 116 may be approximately 0.45 cm. Such a diameter range provides sufficient strength to support the weight of branches 84, with its sub-branches, artificial foliage, combustion-resistant wire 180, and so on, for artificial trees of the present invention, including trees having assembled heights of 4 feet to 12 feet.

In an embodiment, the majority of rods 116 in a single tree may comprise substantially the same diameter; in other embodiments, the diameter of rods 116 may vary, with diameters on a bottom portion of a tree having rod 116 diameters being greater than rod 116 diameters near a top portion of the tree. This is in part due to larger, and longer, branches 84 being at, on, or near a bottom portion of the tree, as compared to smaller, shorter, branches 84 being at, on, or near a top portion of the tree.

In various embodiments, each of the sub-branches 98 includes a flexible member 148 having a main portion 152 intermediate a first end portion 156 attached to one of the first and second rods 116, 132 and a second end portion 160 extended outwardly. In some embodiments, each of the sub-branches 98 additionally includes a strip of artificial foliage 164 connected along a length of the flexible member 148. The strip of artificial foliage 164 may be a ribbon or length of polymer material that includes a plurality of longitudinal cuts along the length of the strip 164 to define a plurality of foliage strips 168. In certain embodiments, the plurality of foliage strips 168 are sized and shaped accordingly to simulate various types needles present in coniferous trees, such as pine trees or other types of foliage that includes needles.

For example, in one or more embodiments the strip of artificial foliage 164 is attached to the flexible member 148 such that the plurality of foliage strips 168 are configured to extend outwardly from the flexible member 148. For example, the strip 164 may be twisted about the flexible member 148 such that plurality of foliage strips 168 extend outwardly in various directions. In one or more embodiments, the strip of artificial foliage 164 is constructed using various types of polymer material. For example, in some embodiments, the strip 164 may be constructed using PVC (polyvinyl chloride), polyethylene, polypropylene, or other suitable plastic polymer material.

In various embodiments, the first and second branch portions 88, 104 each include windings 92, 108 disposed along a portion of the first and second rods 116, 132. The windings 92, 108 may be composed of one or more wires, strands, twine, threads, and the like, that are wrapped latitudinally about a portion of the rods 116, 132 and the first end portion 156 of each of the sub-branches 98 to attach the sub-branches 98 to the first and second rod 116, 132. In certain embodiments, winding 92 may be wrapped about a portion of the rod 116 and the first end portion 140 of the second rod 132 to attach the second branch portion 104 to the first branch portion 88.

In various embodiments, the winding 92, 108 is formed from a combustion-resistant twine 176. In an embodiment, the combustion-resistant twine 176 includes two or more discrete wires, threads, strands, and the like, twisted together. At least one of the two or more strands in the twine 176 is substantially combustion resistant. For example, the combustion-resistant twine 176 may include a combination of one or more combustion-resistant wires 180 and one or more polymer threads 184 which are twined or twisted together. In other embodiments, the combustion-resistant twine 176 may not be a "twine" at all, but rather may comprise a single strand comprising a combustion-resistant material.

In one or more embodiments, the combustion-resistant strand or wire 180 is constructed from an alloyed or unalloyed metal. It will be understood that the term "wire" is meant to describe a strand, a thread, a string, a filament and so on, that may be metallic in nature in some embodiments. However, the term "wire" is not intended to be limited to any particular material, or to be limited to a single strand, thread or fiber.

In an embodiment, the metal may have a melting temperature equal to or greater than about four hundred degrees Celsius. For example, in some embodiments, the wire 180 may be constructed from aluminum, copper, iron, steel, stainless steel, nickel, zinc, or a combination or alloy, or another suitable metal. In an embodiment, combustion-resistant wire 180 may comprise a low-carbon iron wire, including a low-carbon iron wire that may be semi-rigid, and may have a zinc cladding. In an embodiment, combustion-resistant wire 180 may comprise a steel wire, a stainless steel wire, or a steel wire with zinc cladding or coating. The use of zinc cladding for wire 180 prevents rusting of the wire, which could compromise the integrity of wire 180 over time, affecting the ability to hold sub-branches to their respective branches In other embodiments, "wire" 180 may comprise non-metallic material having combustion-resistant properties, in whole or in part. In one such embodiment, wires 180 may include highly-combustion or fire-resistant polymers.

In an embodiment, the combustion-resistant wire 180 may comprise a metallic material, such as described above, that has been annealed, thereby increasing the ductility and workability of wire 180. Annealing and subsequent ductility and workability of combustion-resistant wire 180 improves the bend radius of the wire (allows it to bend in a smaller radius) such that it can be wound or bent around a relatively small diameter rod 166 without breaking or otherwise being damaged. A bend radius of wire 180 as applied to a tree of the present invention in which wire 180 is bent around, or wound around, a rod 116 defining a diameter as described herein, may be approximately equal to the radius corresponding to the diameter of rod 116. In an embodiment, a bend radius of wire 180 is in the range of 0.05 cm to 0.5 cm for rods 116 having diameters in the range of 0.1 cm to 1 cm; a bend radius in the range of 0.15 cm to 0.3 cm for rods 116 having diameters in the range of 0.3 cm to 0.6 cm; a bend radius in the range of 0.2 cm to 0.25 cm for rods 116 having diameters in the range of 0.4 cm to 0.5 cm; and so on.

In addition to combustion-resistant wire 180 being annealed an annealed wire or strand, wire 180 may also be a cold-worked wire, i.e., a wire drawn or produced through a cold-working process. Cold-drawn wires 180 may provide the additional benefit of having more precise and consistent measurements, thereby improving the quality of the wire 180 with respect to failure at high temperatures due to inconsistent, and in particular smaller, diameters along a length of a wire 180.

In some embodiments, the wire 180 has a diameter or average diameter in the range of 0.1 mm to 1 mm wide. In some embodiments, the wire 180 has a diameter in the range of 0.1 mm to 0.3 mm. In some embodiments, the wire 180 has a diameter of about 0.2 mm. In various embodiments, the melting point of the wire 180 at least partially depends on the diameter. Accordingly, in some embodiments, the diameter of the wire 180 may be chosen based on desired combustion resistance for the wire, while accounting for a diameter thin enough for windability about the rod 116.

In an embodiment, combustion-resistant wire 180 may comprise an outer coating, such as a coating or paint that causes the wire 180 to have a desired color. In one such embodiment, the color may be brown so that the windings of the wire appear similar to the color of the branch portion of a pine tree. In other embodiments, wire 180 may comprise a green color so as to minimize the ability to see the wire 180 amongst the green-colored needles or artificial foliage 164 of the branches.

It will be understood that any combination of materials and properties described above with respect to combustion-resistant wire 180 may be used to create various embodiments of combustion-resistant wire 180 of the invention, and as used on a branch or tree of the present invention. For example, in one embodiment, combustion-resistant wire 180 may comprise a 0.2 mm diameter, zinc-clad iron wire that is annealed and cold-worked.

The polymer thread 184 may be constructed using various types of polymer material. For example, in some embodiments, the polymer thread 184 may be constructed using PVC (polyvinyl chloride), polyethylene, polypropylene, or other suitable plastic polymer material. In certain embodiments the combustion-resistant twine 176 may include, as an addition or substitute to the polymer thread 184, a non-polymer thread, such as a natural or synthetic fiber.

In an embodiment, thread 184 may not comprise a polymer thread, but may wholloy or partly comprise a natural or synthetic fiber, such as a cotton fiber.

In an embodiment, polymer thread 184 may comprise a desired color so as to minimize or deemphasize the presence of the polymer thread 184. In on such embodiment, polymer thread comprises a color that is substantially the same as the artificial foliage 164. In another embodiment emphasizing the appearance of polymer thread 184, polymer thread 184 comprises a brown color, to resemble a bark of a tree branch. In an embodiment, polymer thread 184 may comprise a color that is the same as, or substantially the same as, combustion-resistant wire 180, thereby presenting a more uniform appearance.

In an embodiment, polymer thread 184 may comprise multiple strands or threads, and may comprise a yarn of multiple fibers. In an embodiment, polymer thread 184 comprises a polymer yarn having an average linear mass density in the range of 1500-2500 Denier. In an embodiment, polymer thread 184 comprising a yarn may have an average linear mass density of approximately 1900 Denier. The use of a yarn may be helpful in covering exposed areas of rod 116, in addition to providing an appropriate strength such that polymer thread 184 will not break during assembly of the branch.

The combustion-resistant twine 176 can vary, according to one or more embodiments. For example, the combustion-resistant twine 176 may include varying numbers of combustion-resistant wire 180 and polymer threads 184 in the twine 176. In some embodiments, the combustion-resistant twine 176 may include a single combustion-resistant wire 180 and a single polymer thread 184. In certain embodiments, the combustion-resistant twine 176 may have a plurality of combustion-resistant wire 180 and polymer thread 184. In some embodiments, the combustion-resistant twine 176 may include varying ratios of combustion-resistant wire 180 to polymer thread 184. For example, in some embodiments, the ratio of combustion-resistant wire 180 to polymer thread 184 may be 1:1. In certain embodiments the ratio of combustion-resistant wire 180 to polymer thread 184 may be 2:1. In one or more embodiments, the ratio of combustion-resistant wires 180 to polymer threads 184 may vary based on the desired combustion-resistance properties of the twine 176. For example, the greater the ratio of combustion-resistant wire 180 to polymer thread 184 in the twine 176, the greater the combustion resistance properties of the twine 176.

In other embodiments, the ration of polymer thread 184 to wire 180 may be selected so as to hide, or make less visible, wire 180. Because combustion-resistant wire 180 may be somewhat shiny, as metal materials may be, a higher ratio of polymer thread 184 to wire 180, e.g., greater than 1:1, may be used to make wire 180 less visible, thereby increasing the aesthetic appearance of the branches and overall tree.

Figure 3A:
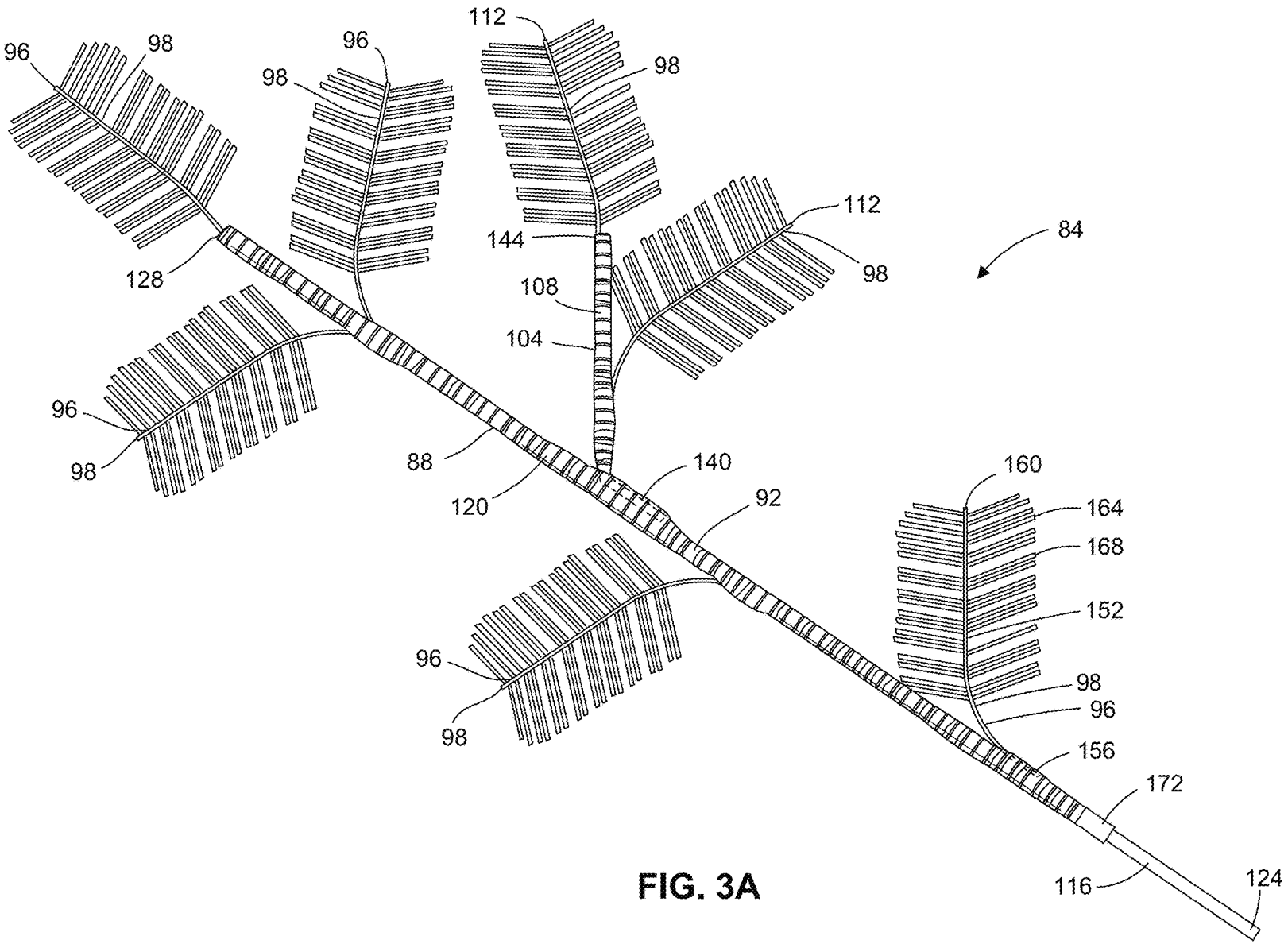
FIG. 3A depicts a perspective view of a branch assembly, according to one or more embodiments of the disclosure.
Figure 3B:
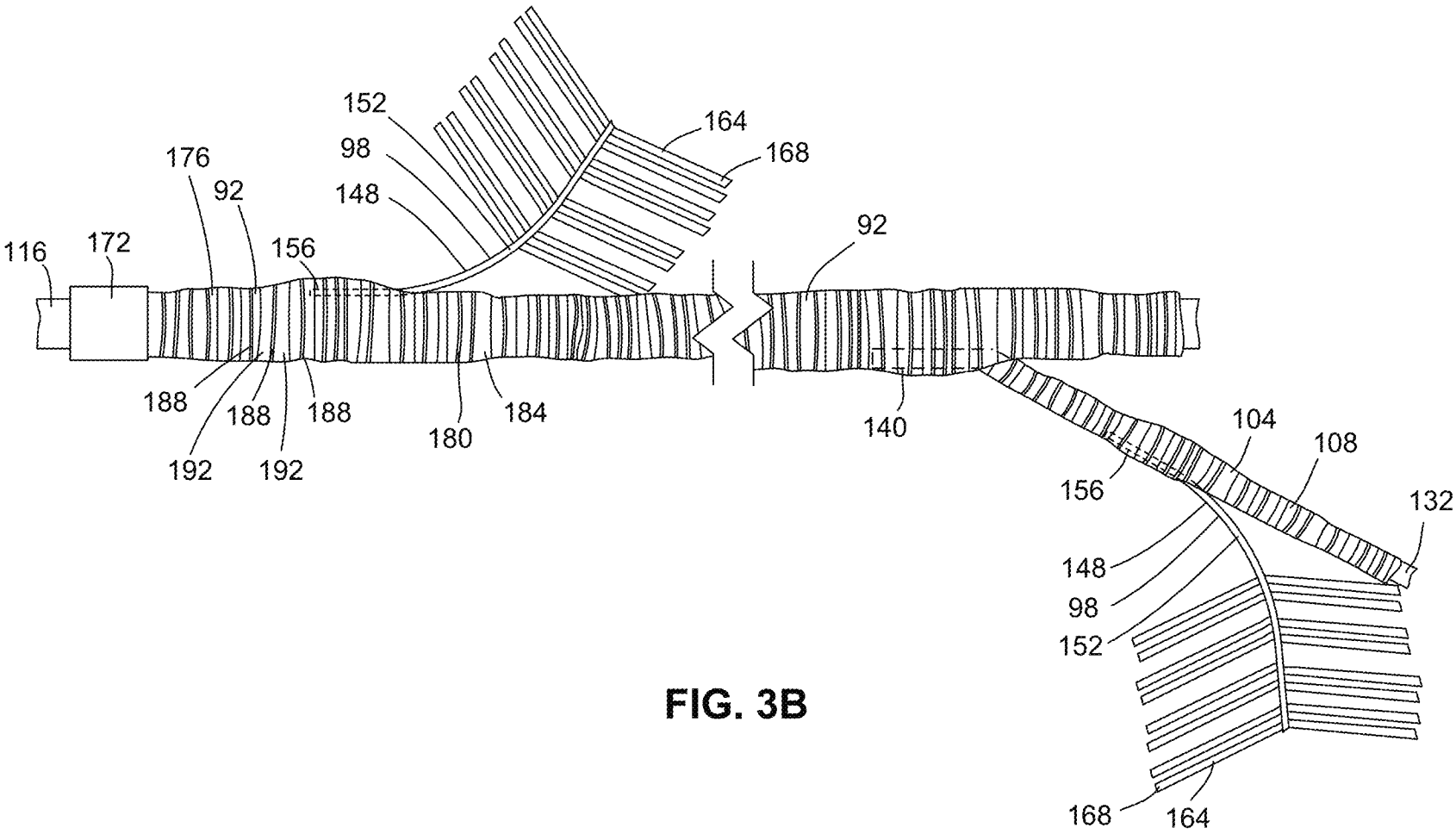
FIG. 3B depicts a plan view of a branch assembly, according to one or more embodiments of the disclosure.

Depicted in FIGS. 3A-3B, the each of the windings 92, 108 are composed from combustion-resistant twine 176 including intertwined wire 180 and polymer thread 184. As a result, the windings 92, 108 each include alternating layers or regions that are defined by the wire 180 and polymer thread 184. For example, the windings 92, 108 include wire regions 188 and polymer regions 192. The wire regions 188 are defined as the width of the wire 180 and the polymer regions 192 are defined as regions between each of the wire regions 188. In various embodiments, the size of the respective polymer regions 192 is based on the twist rate of the wire 180 in the windings 92, 108. For example, the greater the pitch or angle of rotation of the wire 180 in the winding 92, 108, the greater the density of wire 180 along the branch assembly 84. Thus, the space between each wire 180 rotation is smaller, decreasing the size of the respective polymer regions. In various embodiments, the density of wire 180 along the branch assembly 84 is varied based on desired combustion-resistance characteristics for the branch assembly 84. For example, in certain embodiments the greater the desired combustion-resistance, the greater the density of wire 180.

In various embodiments, the first branch portion 88 additionally includes a securing device or portion, such as a stopper 172 placed about, or over, the winding 92 that secures the winding 92 in place on the rod 116 and prevents unraveling. Securing portion 172, in an embodiment, wraps around rod 116 and winding 92

Figure 4A:
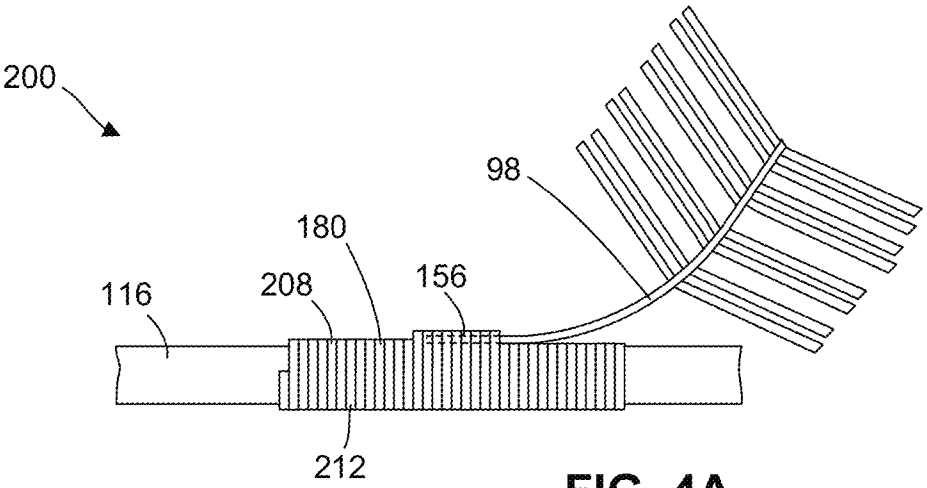
FIG. 4A depicts a branch assembly having a winding including a combustion-resistant wire layer, according to one or more embodiments of the disclosure.
Figure 4B:
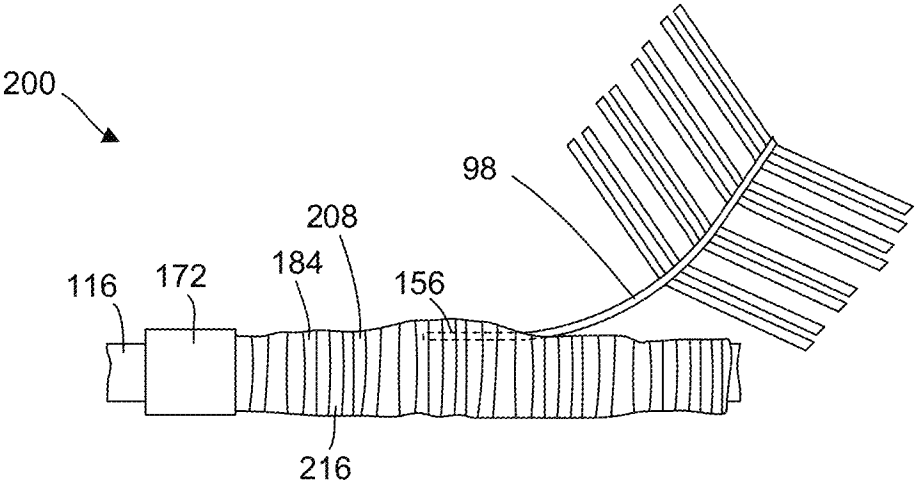
FIG. 4B depicts a branch assembly having a winding including a combustion-resistant wire layer and a polymer thread layer, according to one or more embodiments of the disclosure.
Figure 4C:
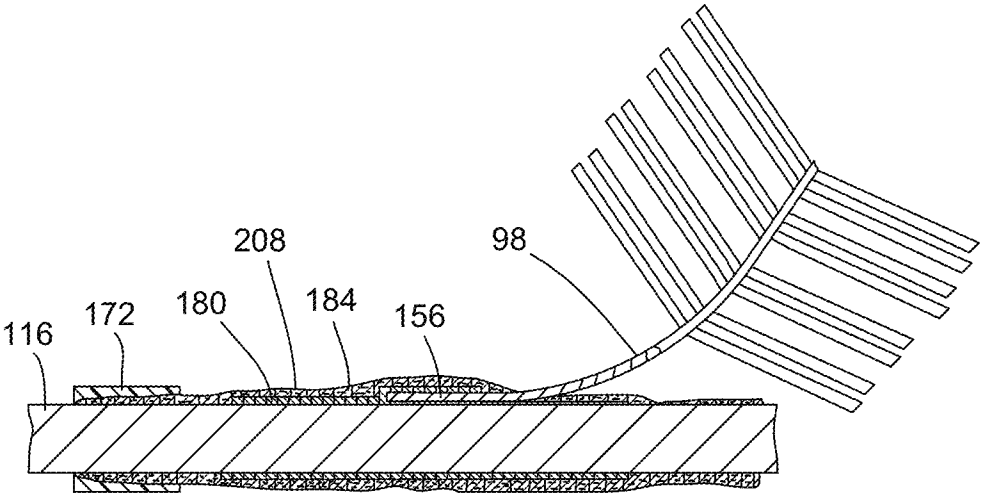
FIG. 4C depicts a cross-section view of the branch assembly of FIG. 4B.

Referring to FIGS. 4A-4C, a portion of a branch assembly 200 is depicted according to one or more embodiments of the disclosure. The branch assembly 200 may share like elements with the branch assembly 84 depicted in FIGS. 3A-3B. Like elements are identified with like reference numerals. For example, branch assembly 200 includes rod 116 and one or more attached sub-branches 98.

In one or more embodiments, the branch assembly 200 includes a winding 208 including one or more layers of material wrapped about the rod 116 and a first end 156 of the sub-branch 98, to attach the sub-branch 98 to the rod 116.

For example, depicted in FIG. 4A, the winding 208 includes a first layer 212 of combustion-resistant wire 180 disposed along a portion of the rod 116. In one or more embodiments, the wire 180 is wrapped latitudinally about a length of the rod 116, and wrapped directly about the rod 116 and the first end portion 156 of the sub-branch 98 to attach the sub-branch 98 to the rod 116. In various embodiments, the first layer 212 includes a sufficient amount of wire 180 such that the first layer 212 secures each of the sub-branches 98 to the rod 116. In some embodiments, the winding 208 just includes the wire layer 180.

Depicted in FIGS. 4B-4C, the branch assembly 200 may include a winding 208 that additionally includes a second layer 216 of polymer thread 184 wrapped about the first layer 212 of wire 180. In various embodiments, the polymer thread 184 is relatively flexible, and may be tautly wound about the wire 180 and the rod 116 and stretched to hold tight. An elastomeric stopper 172 may be additionally placed about the winding 208 to secure the polymer thread 184 in place on the rod 116. In some embodiments, due to tension of the polymer thread 184, the polymer thread 184 intermingles with wire 180, filling in various spaces or openings in the winding 208 left by the wire 180.

Figure 5:
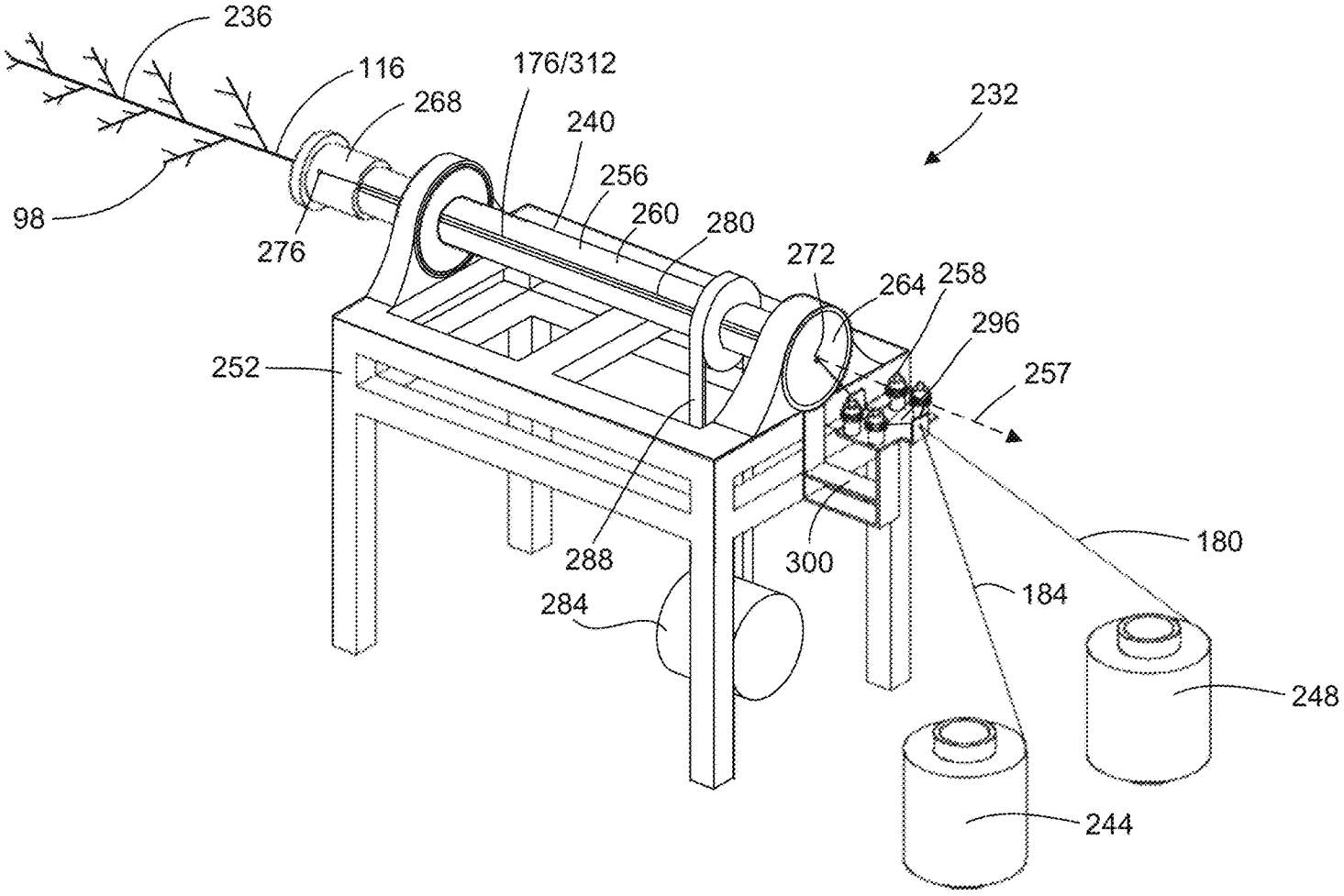
FIG. 5 depicts a system for manufacturing a branch assembly, according to one or more embodiments of the disclosure.
Figure 6:
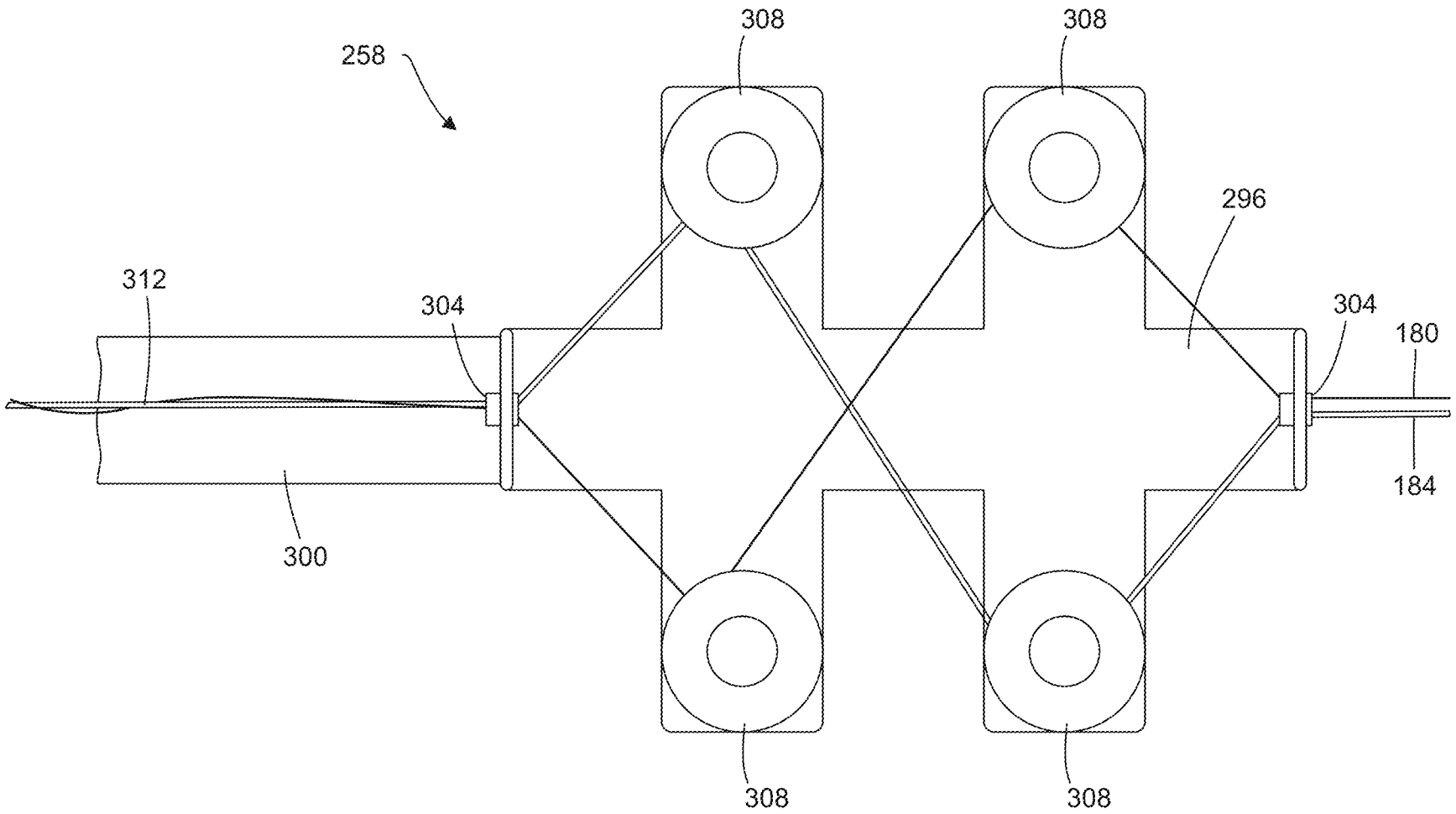
FIG. 6 depicts a top view of a tensioning portion for a system for manufacturing a branch assembly, according to one or more embodiments of the disclosure.

Referring to FIGS. 5-6, a system 232 for manufacturing a branch assembly 236, and methods of manufacturing a branch assembly 236, are depicted according to one or more embodiments of the disclosure. The system 232 may include a branch wrapping device 240, a spool 244 of polymer thread 184, and a spool 248 of combustion-resistant wire 180. In certain embodiments, the branch wrapping device 240 includes a support platform 252, an axle portion 256, and a tensioning portion 258.

In one or more embodiments, the axle portion 256 is a cylindrical shaft that is rotatably mounted to the support platform 252 for rotation of the axle portion 256 about a central axis 257. The axle portion 256 may include a main portion 260 that extends between a rearward intake portion 264 to a forward winding portion 268. In various embodiments, the intake portion 264 includes a rearward aperture 272 and the winding portion 268 includes a forward aperture 276. In some embodiments the axle portion 256 additionally includes a latitudinal groove 280 extending along the main portion 260 and between the forward and reward apertures 272, 276. In various embodiments, the axle portion 256 is operably coupled with a motor 284 via a belt 288 for active driving of rotation of the axle portion 256.

In one or more embodiments, the tensioning portion 258 is attached to the rearward portion of the support platform 252 and is generally aligned with the central axis 257. The tensioning portion 258 may include a platform portion 296 offset rearwardly from the support platform 252 by offset portion 300. The platform portion 296 includes apertures 304 aligned with the central axis 257 and one or more tensioning spools 308 positioned between apertures 304.

In operation, the polymer thread 184 and wire 180 may be initially threaded through the branch wrapping device 240. For example, in some embodiments the polymer thread 184 and the wire 180 are unwound from their respective spools 240, 244 and threaded through the branch wrapping device 240, through the tensioning portion 258 and along the axle portion 256. In certain embodiments, the thread 184 and wire 180 are inserted through the aperture 272 and pulled along the main portion 260 in the latitudinal groove 280 to the forward winding portion 268. The thread 184 and wire 180 may be inserted through the aperture 276 in the winding portion 268 and placed in a hollow interior winding region defined in the forward portion of the branch wrapping device 240.

In one or more embodiments, once initially threaded, the branch wrapping device 240 initiates rotation for the axle portion 256, and, as the axle portion 256 spins, the thread 184 and the wire 180, are pulled from spools 244, 248 through the tensioning portion 258, along the latitudinal groove 180 of the main portion 260, and through the aperture 276 in the winding portion 268.

In various embodiments, as the polymer thread 184 and/or the combustion-resistant wire 180 are pulled through the tensioning portion 258, the thread 184 and wire 180 are threaded around one or more of the tensioning spools 308. The tensioning spools 308 maintain tension in the thread 184 and wire 180 as it is pulled between the intake portion 264 of the branch wrapping device 240 and spools 244, 248. By maintaining tension, the tensioning spools 308 reduce the potential of tangling or knotting of the polymer thread 184 and/or wire 180 as they are pulled from their respective spools 240, 244, potentially stopping the manufacturing process.

As seen in FIG. 6, the tensioning portion 258 includes four tensioning spools 308, with two tensioning spools each for the wire 180 and the polymer thread 184. Between apertures 304 the thread 184 and wire 180 are threaded through the spools 308, maintaining tension, and eliminating potential tangles prior to being pulled into the intake portion 264. In various embodiments, the tensioning portion 258 includes less than or greater than 4 spools. For example, in some embodiments, the tensioning portion 258 includes only two spools 308.

In some embodiments, the wire 180 may be less prone to tangling than the polymer thread 184 and is not threaded through the tensioning spools 180. For example, the polymer thread 184 may be tensioned by spools 308 and the wire 180 may simply pass directly through each of the apertures 304.

The branch wrapping device 240 is configured to receive the rod 116 and a plurality of attached sub-branches 98 in the forward winding portion 268. In various embodiments, the rod 116 and sub-branches 98 may be initially attached together via a temporary attachment means, such as glue, tape, or other attachment mechanism. In some embodiments, the sub-branches 98 and the rod 116 may be held together by hand. Once together, the rod 116 and sub-branches 98 may be inserted into the device 240. As the axle portion 256 rotates the device 240 wraps the polymer thread 184 and/or wire 180 about the rod 116 and the sub-branches 98 and forms a winding on the branch assembly 236. Once the winding is formed the polymer thread 184 and wire 180 may be cut and secured in place on the branch assembly 236.

In certain embodiments, as the axle portion 256 rotates, the polymer thread 184 and wire 180 twine together between the tensioning portion 258 and the intake portion 264, forming a combustion-resistant twine 312 (or 176) which is used to form the winding, as described above with reference to FIGS. 3A-3B.

In some embodiments, the device 88 may alternate between wrapping the wire 180 and the polymer thread 184. For example, in some embodiments, the device 88 may be configured to first wrap wire 180 about the rod 116 and the plurality of sub-branches 98. As a result, in some embodiments, the branch assembly 84 may include the rod 116 and the sub-branches 98 attached together primarily by a first layer of the wire 180 wrapped directly on the rod 116 and over an end of each of the sub-branches 98, as described above with reference to FIG. 4A.

In certain embodiments, the device 88 may then be configured to intake the polymer thread 184 to wrap around the rod 116 and the first layer of the wire 180. This forms a second layer that covers the first layer of wire 180. In various embodiments, the polymer thread 184 covers the wire layer to improve the appearance of the branch assembly 84, for example, the polymer thread 184 may more accurately simulate the appearance of bark. Additionally, the polymer thread 184 may cover potentially sharp edges of the wire 180.

Consequently, embodiments include the various methods and method steps described above. This includes a method of manufacturing a combustion-resistant branch assembly that comprises connecting a first end portion of a first group of sub-branches to a first branch portion, the first branch portion including a first rod having a main portion intermediate a first end portion and a second end portion, and each sub-branch of the first group of sub-branches including a flexible member having the first end portion and a second end portion and a strip of artificial foliage attached along a portion of the flexible member, the strip having a plurality of polymer strands extended outwardly from the flexible member; and winding a combustion-resistant strand latitudinally about the first branch portion and the connected first end portion of each sub-branch of the first group of sub-branches, thereby attaching the first group of sub-branches to the first branch portion. In an embodiment, the combustion-resistant strand is included in a combustion-resistant twine that further includes a polymer thread intertwined with the combustion-resistant wire.

Figure 7B:
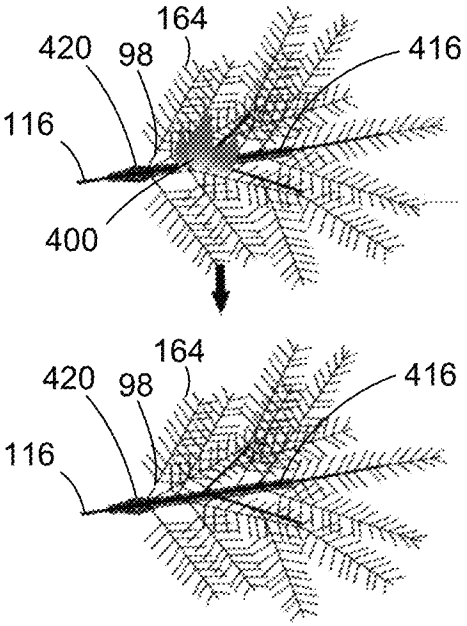
FIGS. 7A-7C depicts various stages of combustion of an artificial tree, according to one or more embodiments of the disclosure.
Figure 7A:
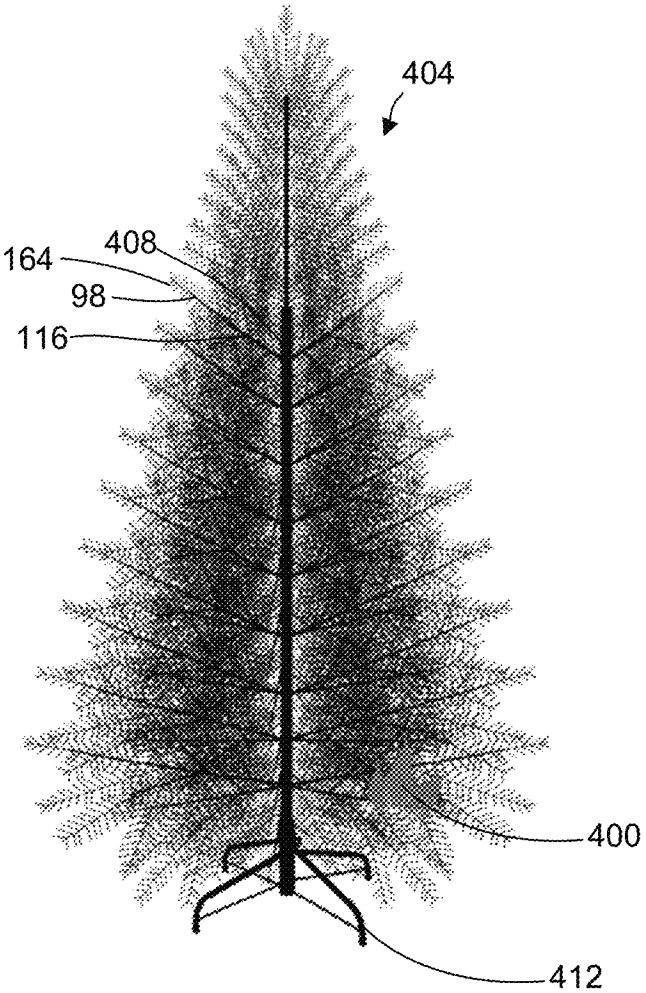
Figure 7C:
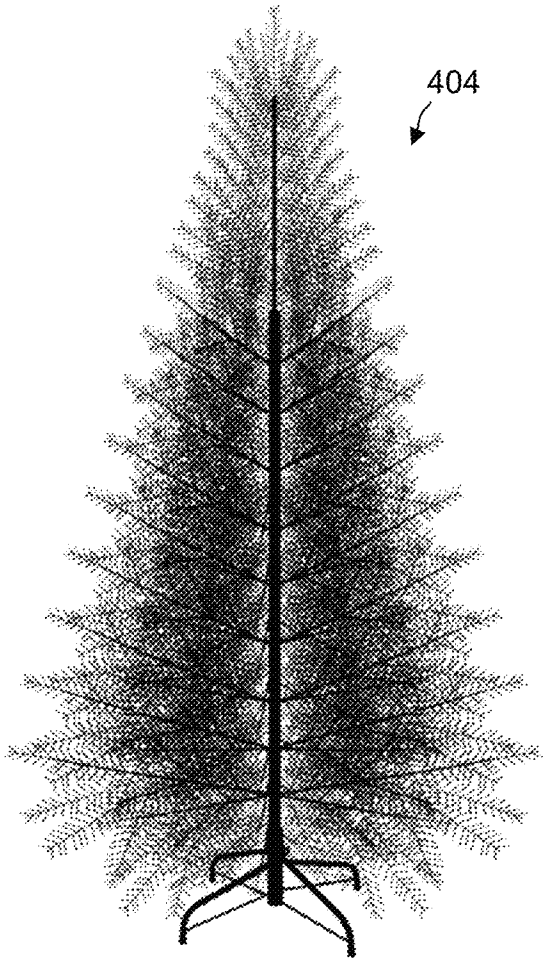

FIGS. 7A-7C depicts various stages of a fire 400 in an artificial tree 404, according to one or more embodiments of the disclosure. In one or more embodiments, the artificial tree 404 includes a trunk portion 408 a base portion 412 for receiving the trunk portion 408, and a plurality of branch assemblies 416 coupled to the trunk portion 408. As described herein, each of the branch assemblies 416 may include of a rod 116 and a plurality of sub-branches 98 outwardly extending from the rod 116. Each of the sub-branches 98 may include artificial foliage 164 for simulating the look and/or feel of a real tree. As described, each of the sub-branches 98 may be attached to the rod 116 via a winding 420 that includes a layer of wire wrapped about the rod 116 and an end portion of the various sub-branches 98 to attach the two together. Additionally in some embodiments, the winding 420 may include a polymer thread as a portion of the winding 420.

In an embodiment, all, or substantially all branches 416 of tree 404 comprise branches that include combustion-resistant twine 176 or 312, so as to maximize the combustion-resistant properties of tree 404. However, in an alternate embodiment, only a portion of branches 416 may include combustion-resistant twine 176 or 312.

In one such embodiment, only branches on a lower portion of tree 404 include branches 316 made with combustion-resistant twine, while other branches are made with standard materials, or they lack combustion-resistant twine. Because many fires originate from underneath a tree or at floor level, it may be sufficient to include only some combustion-resistant branches 416 on tree 404, and in particular lower branches 416. In one embodiment, tree 404 includes multiple tree sections, separable along trunk 408, i.e., trunk 408 includes multiple portions, and only the lowermost tree section includes combustion-resistant branches 416 with combustion-resistant twine 176 or 312. In an embodiment, approximately 50% of the branches of tree 404 include combustion-resistant branches 416 with combustion-resistant twine. In one such embodiment, the 50% of the branches including branches 416 are located on the bottom half of tree 404.

In an embodiment, all but an uppermost tree section includes combustion-resistant branches. For some tree designs, this may be done without sacrificing the combustion-resistant nature of tree 404 because branches near a top of the tree are generally shorter and fewer than those nearer a bottom of tree 404, and therefore provide less fuel for a potential fire.

In an embodiment, tree 404 may include 100% combustion-resistant branches; in an embodiment, tree 404 may include less than 100% combustion-resistant branches, such as: including approximately 50% combustion-resistant branches, or 75-90%; or including a range of 25-75% combustion-resistant branches.

In FIG. 7A, a fire 400 is started in a branch 416 of the tree 404. Depicted in FIGS. 7A-7C, as time passes, the fire 400 may consume or melt the polymer thread winding along the branch 416. However, the winding 420 remains at least partially intact due to the layer of wire included in the winding 420. As a result, the various sub-branches 98 are kept secured to the rod 116 as the polymer thread and other materials in the branch 416 are consumed. Accordingly, in some embodiments, the artificial tree 404 maintains the various sub-branches 98 and the branches 416 in a spacing arrangement that reduces the spread of the fire 400. For example, because the various materials on the sub-branches 98, and the sub-branches 98 themselves, are maintained in position in the artificial tree 400, it spreads out the flammable material so that potential fuel for the fire 400 is more spread out, reducing the overall heat generated and reducing the likelihood of fire spread.

For example, in FIGS. 7B-7C, the progression of the fire 400 is depicted. The fire 400 consumes material in the branch assembly 416. However, due to the wire layer, once the fire 400 consumes some material in the branch assembly 416 the fire 400 eventually burns out and the sub-branches are maintained in position secured to the branch assembly 416 by the combustion-resistant wire. As such, the fire is isolated in the artificial tree 404.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A method of manufacturing an artificial tree having an axially-extending trunk with combustion-resistant and less combustion-resistant branch assemblies, the method comprising:

connecting a first end portion of a first group of sub-branches to a first branch portion, the first branch portion including a first rod having a main portion intermediate a first end portion and a second end portion, and each sub-branch of the first group of sub-branches including a flexible member having the first end portion and a second end portion and a strip of artificial foliage attached along a portion of the flexible member, the strip having a plurality of polymer strands extended outwardly from the flexible member;

winding a continuous combustion-resistant metal thread latitudinally about the first branch portion and the connected first end portion of each sub-branch of the first group of sub-branches to form multiple windings of the continuous combustion-resistant metal thread about the first branch portion and the connected first end portion of each sub-branch of the first group of sub-branches, the continuous combustion-resistant metal thread having a diameter in the range of 0.1 mm to 1 mm, thereby attaching the first group of sub-branches to the first branch portion to form the combustion-resistant branch assembly;

connecting the combustion-resistant branch assembly to the trunk of the artificial tree at a first trunk position;

connecting a first end portion of each of a second group of sub-branches to a second branch portion, the second branch portion including a second rod having a main portion intermediate a first end portion and a second end portion, and each sub-branch of the second group of sub-branches including a flexible member having a first end portion and a second end portion and a strip of artificial foliage attached along a portion of the flexible member, the strip having a plurality of polymer strands extended outwardly from the flexible member;

winding a less combustion-resistant thread, which is less resistant to combustion than the combustion-resistant metal thread, latitudinally about the second branch portion and the first end portion of each sub-branch of the second group of sub-branches, without winding the combustion-resistant metal thread about the second branch portion and the first end portion of each sub-branch of the second group of sub-branches, thereby attaching the second group of sub-branches to the second branch portion with the less combustion-resistant thread to form the less combustion-resistant branch assembly; and connecting the less combustion-resistant branch assembly to the trunk of the artificial tree at a second trunk position, the second trunk position being axially displaced along the trunk from the first trunk position, such that the second trunk position is above the first trunk position when the artificial tree is an upright and assembled configuration.

2. The method of claim 1, wherein:

the combustion-resistant metal thread is included in a combustion-resistant twine that further includes a polymer thread intertwined with the combustion-resistant metal thread.

3. The method of claim 1, wherein the metal thread has a melting temperature equal to or greater than 400 degrees Celsius.

4. The method of claim 3, wherein the metal thread comprises iron.

5. The method of claim 4, wherein the metal thread comprises zinc-cladded iron.

6. The method of claim 5, wherein the metal thread is coated or painted green or brown.

* * * * *